United States Patent [19]

Chmura et al.

[11] 4,394,421

[45] Jul. 19, 1983

[54] THREAD FORMING OF SINTERED POROUS METAL SHAPES

[75] Inventors: William J. Chmura, Southington; Ronald S. Slusarski, Berlin, both of Conn.

[73] Assignee: Textron Inc., Providence, R.I.

[21] Appl. No.: 235,641

[22] Filed: Feb. 18, 1981

Related U.S. Application Data

[63] Continuation of Ser. No. 55,508, Jul. 9, 1979, abandoned.

[51] Int. Cl.[3] ..... B21H 3/04; B22F 3/24; B22F 5/06; B32B 5/14

[52] U.S. Cl. ..... 428/547; 10/10 R; 10/27 R; 72/104; 428/592; 428/610

[58] Field of Search ..... 428/547, 592, 610; 148/126; 72/104; 10/10 R, 27 R; 29/420.5

[56] References Cited

U.S. PATENT DOCUMENTS

| | | | |
|---|---|---|---|
| 2,447,434 | 8/1948 | Schwarzkopf | 264/111 |
| 2,549,939 | 4/1951 | Shaw et al. | 29/420.5 X |
| 2,941,288 | 6/1960 | Whitehouse | 29/420.5 |
| 3,668,951 | 6/1972 | Talmadge | 428/610 X |
| 3,782,794 | 1/1974 | Chmura et al. | 308/193 |
| 4,026,657 | 5/1977 | Chmura | 403/122 |

OTHER PUBLICATIONS

Brodski, A. M.; "Small Thread Rolling Dies" in Machines & Tooling, vol. XLIII, Nailly 1972, pp. 54–57.

*Primary Examiner*—Mark Bell

*Attorney, Agent, or Firm*—Hopgood, Calimafde, Kalil, Blaustein & Judlowe

[57] ABSTRACT

A method of thread rolling a cylindrical sintered P/M blank is provided comprising, forming a sintered cylindrical powder metal (P/M) blank of density ranging from about 75% to 92% of the actual density of said metal blank having a selected diameter larger than the final pitch diameter of a predetermined roll threaded product produced therefrom and not substantially exceeding the outside diameter of said predetermined roll threaded product. The P/M blank diameter selected is substantially inversely related to the density of the blank, the P/M diameter selected being correlated to produce a substantially full thread. The sintered P/M blank is then thread rolled using a threading die corresponding to the gage of the predetermined roll threaded product to be produced.

16 Claims, 8 Drawing Figures

THREAD FORMING OF SINTERED POROUS METAL SHAPES

This is a continuation, of application Ser. No. 055,508 filed July 9, 1979, now abandoned.

This invention relates to thread rolled or thread formed metal products produced from sintered powder metal (P/M) blanks and, in particular, to a method of producing thread rolled P/M products from sintered cylindrical P/M blanks.

State of the Art

It is known to produce threaded products from cylindrical wrought metal blanks by using a thread rolling die. When rolling a thread on a cylindrical workpiece or blank, the die penetrates the surface of the blank to form the root of the thread. This forces displaced material radially outward to form the crest and the major diameter of the thread. The diameter of the blanks used for thread rolling wrought metals is usually the pitch diameter of the finished thread.

Because thread rolling does not remove or compress material, an essential requirement in thread rolling is that the blank should not contain more than the correct amount of material to form the finished thread, otherwise the dies tend to become overloaded. If the diameter of the blank is less than the correct amount, an incomplete thread form results.

It is very important that the outside diameter (O.D.) of the blank be as accurate as possible. As the volume of the thread above the pitch diameter (addendum) of an American Standard thread very nearly equals the volume of the material displaced from below (dedendum), it becomes clearly apparent that the diameter of the blank approximates the pitch diameter of the finished thread. Failure to control the blank diameter is one of the biggest causes of premature die failure.

A balanced thread is one in which the thread volume above the pitch diameter is substantially equal to the thread volume below the pitch diameter. Generally, it is recommended that the diameter of the wrought metal blank be less than the actual pitch diameter to allow for "grow room" before the maximum allowable blank diameter is reached. Metal can be forced to flow, but for all practical purposes it cannot be compressed.

Thus, as stated earlier, blank dimensions must be accurately controlled. For example, the final thread diameter tolerances are generally two to three times that of the starting blank diameter tolerances. So long as the wrought metal blank is uniform and dimensionally accurate, thread rolling has the unique inherent ability to maintain the accuracy of the original set up during long runs of high speed production.

It would be desirable to provide a method of thread rolling metal blanks which does not require highly dimensionally accurate blanks and which is capable of providing high production rates and a roll threaded product having a good combination of physical properties.

OBJECTS OF THE INVENTION

It is an object of the invention to provide a powder metallurgy method for producing thread rolled metal products.

Another object is to provide a thread rolled sintered P/M product characterized metallographically by a structure in which the rolled and mechanically formed threads from the root to the crest of the threads are highly dense at and below the surface thereof and exhibit a density of at least about 95%, e.g., at least about 98%, of the actual density of the metal, with the core of the threaded product below the threads having a porosity defined by an average density of about 75% to 92%, generally about 80% to 92%, of the actual density of the metal.

These and other objects will more clearly appear when taken in conjunction with the following disclosure and the accompanying drawings, wherein:

FIG. is a portion of a sintered cylindrical P/M blank;

FIG. 4A is a sintered P/M blank prior to thread rolling, while

STATEMENT OF THE INVENTION

An advantage of the invention is that the sintered P/M blank need not be as accurately dimensioned as a wrought metal blank in order to achieve a quality end product. For example, the P/M blank diameter is greater than the recommended blank diameter of the wrought material, that is to say, greater than the pitch diameter, so long as the starting sintered P/M blank is porous and has a density ranging from about 75% to 92% of the actual density of the metal.

Work hardening and grain orientation of the P/M blank is similar to that obtained with wrought material but to a lesser degree due to porosity elimination by densification. A major advantage in using P/M material is the elimination of embrittling strength-reducing porosity in areas within and at the root section where stress concentration is the greatest.

As stated earlier for the wrought material, once the total tooth of the thread is "filled out", no further deformation is permitted or tolerated; whereas, in the case of the P/M blank, further deformation or compression may be achieved with the P/M material merely by further closing the internal pores of the blank. This further deformation increases the depth or zone of desification, thus improving the shear strength of the P/M thread.

The fact that one may start with larger P/M blank diameter and thread roll beyond the point of full thread formation is due to the compressibility of the porous material. Thus, a practical advantage of the invention is that a high precision thread can be formed from a low precision preform or blank. This enables a wide range of flexibility in the process since the dimensions of the blank need not be overly precise and are easily within the capabilities of the P/M process without the need for secondary operations.

Following thread rolling of the sintered P/M blank, the threaded blank may be further sintered to improve its strength followed by heat treatment, should the material employed be heat treatable, such as carbon steel.

Figure 1:
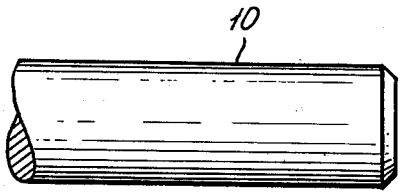
Figure 2:
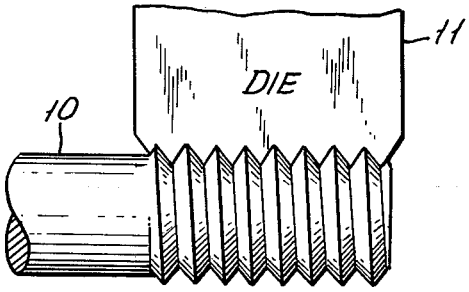
FIG. 2 shows the P/M blank portion in the thread rolled condition.
Figure 3:
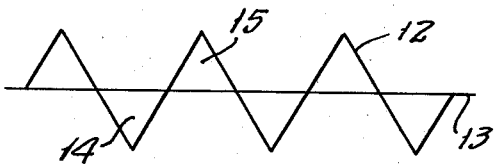
FIG. 3 depicts schematically a typical balanced thread in which the thread volume above the pitch diameter (addendum) is equal to the thread volume below the pitch diameter (dedendum)

A section of a typical cylindrical powder metal blank 10 is depicted in FIG. 1. The blank is shown being threaded by die 11. FIG. 3 is a schematic of a balanced thread 12, with pitch line 13, addendum 14 and equal dedendum 15, the pitch line being midway between the root and the crest of the thread.

Thus, one embodiment of the invention resides in a method of thread rolling a cylindrical sintered P/M blank comprising, forming a sintered cylindrical powder metal (P/M) blank of density ranging from about 75% to 92% of the actual density of said metal blank having a selected diameter larger than the final pitch diameter of a predetermined roll threaded product produced therefrom and not substantially exceeding the outside diameter of said predetermined roll threaded product; the P/M diameter selected being substantially inversely related to the density of said blank over said range of 75% to 92% of the actual density, the P/M diameter selected being correlated to produce a substantially full thread; and then thread rolling said sintered P/M blank using a threading die corresponding to the gage of the predetermined roll threaded product to be produced; thereby producing a threaded product in which the density from the root to the crest of the threads is at least about 95% of the actual density of the metal, the material below the thread having a density ranging from about 75% to 92% of the actual density of the metal.

Figure 4A:
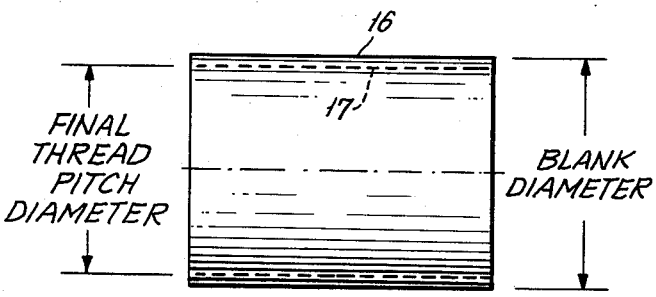
Figure 4B:
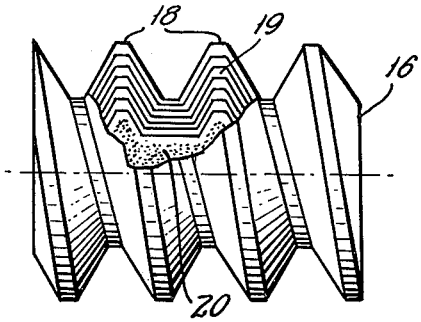
FIG. 4B is the blank following thread rolling partially broken away to show the internal structure, it being understood that the structure is enlarged for purposes of clarity.

By employing a blank diameter in excess of the final pitch diameter, a high degree of densification is assured at the thread portion. This is shown in FIGS. 4A and 4B. In FIG. 4A, a sintered P/M blank 16 is shown, with the pitch diameter indicated by dotted line 17, the threaded blank 16 produced being depicted by FIG. 4B showing the work hardened threads 18 with flow lines 19 shown schematically and the interior porous section or core indicated by the numeral 20. As stated earlier, the surface and subsurface area of the threads at the root and the crest is at least about 95% dense and generally at least about 98% of the actual density of the metal.

Figure 5:
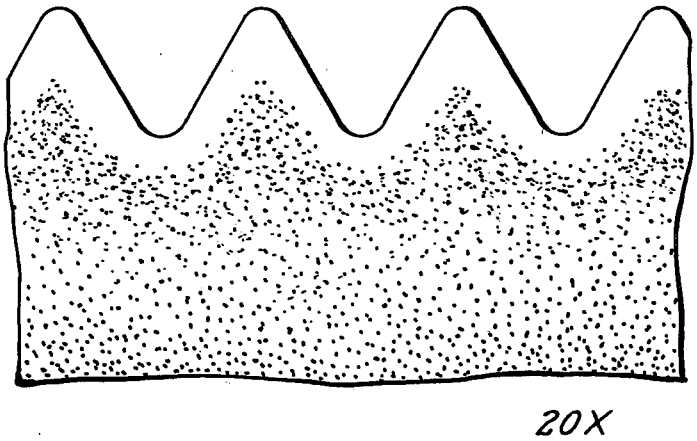
FIG. 5 is a representation of an unetched macrograph at 20 times magnification of a cross section of a thread rolled P/M product showing the high density at the thread portions, particularly high density sub-surface, and the rather high porosity at the core of the thread rolled product.
Figure 6:
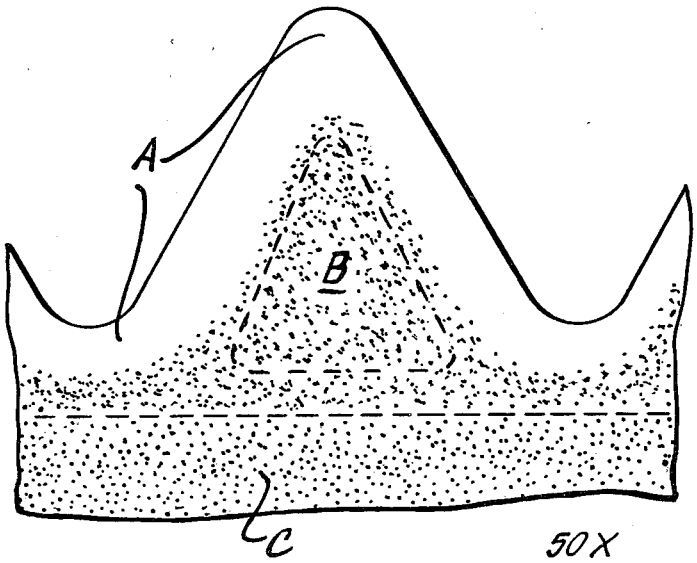
FIG. 6 is the same as FIG. 5, except that it depicts the cross section of the thread rolled P/M product at 50 times magnification.

Representations of photomacrographs taken at 20 times and 50 times magnification, respectively, are shown in FIGS. 5 and 6 which depict cross sections of threaded P/M blanks in the unetched condition.

FIG. 5 is a threaded sintered blank of a size $\frac{3}{8}$–16 UNC that demonstrates the features of forming a powder metal blank. The initial blank diameter was 0.346 inch, whereas a wrought blank must be sized at the pitch diameter of 0.331 inch. The final pitch diameter of the formed P/M thread was measured to be 0.337 inch. A blank diameter of 0.015 inch oversized resulted in a final pitch diameter only 0.003 inch oversized. The difference is explained by the compressive nature of the material.

FIG. 6 is the same part as FIG. 5 except that the magnification is 50 times.

As will be noted in FIG. 6, the threads are very dense, at both the roots and the crests (A), the inner region or tooth core "B" of the tooth being less porous than the original porosity of the blank typified by region "C". The core region "C" has a density ranging from about 75% to 92% and generally 80% to 92% of the actual density of the metal. Region "A" nearest the tooth surfaces has an actual density exceeding 95% and usually 98% of the actual density of the metal. Densification occurs in region "B" with the density between the extremes of "A" and "C".

DETAILS OF THE INVENTION

Powder Metal Compaction

The P/M blank may be made of various metal compositions; for example, steel, aluminum alloys, copper alloys, such as brass and bronze; nickel-base alloys, such as the alloy known by the trademark Monel containing 60% nickel, 37% copper and such residuals as silicon, manganese, etc., making up the balance, among others.

The invention is particularly applicable to steel P/M parts. In the production of a sintered cylindrical blank of steel, a steel powder composition is cold pressed in a cylindrical die dimensioned to produce the desired size. The composition is compacted at a pressure of about 30 to 45 tons per square inch andthe resulting blank then sintered under substantially non-carburizing conditions in a non-oxidizing atmosphere, such as cracked ammonia for about 20 minutes at a temperature of about 2000° F. to 2150° F. The sintered blank has a density of about 75% to 92% of the actual steel density and generally from about 80 or 85% to 92% of the actual density.

Powder Type and Alloy

The types of steel powder used are preferably selected according to those which are economically attractive as well as those which are the most practical. The powder composition may comprise a mixture of elemental powders or comprise the final alloy compositions.

Pre-alloyed powders, however, are preferred such as those produced by atomization from a liquid melt. To assure that such powders are compactable, the carbon is omitted from the composition, the carbon being subsequently blended to the atomized powder prior to compaction. Alternatively, the carbon can be added after the blank has been sintered by caburizing the sintered blank to the desired carbon level.

The invention is applicable to a wide variety of steels, such as 52100-type steels, low nickel-molybdenum steels, molybdenum-manganese steels, and the like. Thus, for the purpose of this invention, a steel is defined as a composition containing by weight at least about 65% iron, about 0.3% to 1.5% carbon, and the balance steel alloying ingredients.

Examples of steels which may be employed in the invention are 4% Ni, 2% Cu, 0.6% C, and the balance iron; 1.5% Mo, 1% C, and the balance iron; 0.5% Mo, 0.5% Mn, 0.8% C, and the balance iron; 1.5% Cr, 0.5% Mo, 1.0% C, and the balance iron; and 1.8% Ni, 0.5% Mo, 0.25% Mn, and 0.6% C, among other well-known steel compositions.

As illustrative of the various embodiments of the invention, the following examples are given:

EXAMPLE 1

Sintered P/M cylindrical steel blanks were produced measuring $\frac{7}{8}$ inch long and 3 inches in diameter in accordance with the method described hereinbefore. The cylinders which had an average density of about 6.6 g/cc had a composition of 0.8% C, 0.50% Mn, 0.50% Mo, and the balance iron.

The cylindrical blanks were cut, machined and ground dry to thread rolling blanks for producing a ⅜-16 UNC thread. The cut blanks were ground to four different diameters, to wit: 0.331", 0.341", 0.346", and 0.356". The blanks were thread rolled on a Reed thread rolling machine referred to in the trade by the designation as a Reed A22HB Cylindrical Die Thread Rolling machine manufactured by the Reed Rolled Thread Die Co., a division of Litton Industries.

The machine was set to roll a full form thread in low carbon steel wrought blanks which, by necessity, were machined to the actual pitch diameter (0.331 inch) of the finished thread (⅜-16 UNC thread). Each of the P/M cylinders were rolled at the same setting using an oil coolant (lubricant). The details of thread rolling are not discussed since thread rolling is well known to those skilled in the art.

Figure 7:
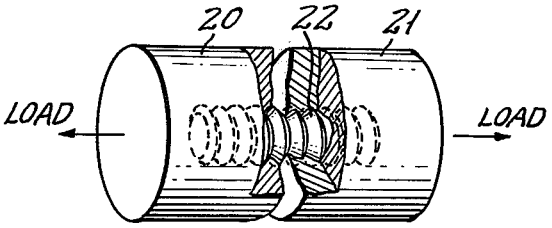
FIG. 7 is a tensile test assembly employed in determining the shear strength of the threaded blank.

Following the thread rolling of each of the P/M blanks, the threaded blanks were tested using the tensile test assembly of FIG. 7 comprising two internally threaded collars or jaws 20, 21 into which both ends of the finished blank 22 are threaded as shown. Load is then applied to both ends of jaws 20, 21 as shown and the load at failure recorded. In the tests conducted, failure occurred upon shearing of all the threads.

For an additional reference of comparison, machined P/M threads were produced in some of the P/M blanks so that a comparison could be made between machined threads and rolled threads of the P/M blanks. The threads formed from P/M blanks of various diameters were measured. Densities measured were an average of the entire formed part and are stated as an average. Hardening was performed by heating to 1565° F. for 20 minutes at temperature in an endothermic atmosphere with the dew point adjusted to be in equilibrium with the carbon content of the blank followed by oil quenching and then tempering for 2 hours at 340° F. in air.

The following table summarizes the dimensional and physical property data obtained. The various P/M threads are designated as A, B, C, and D.

The data of parts C and D furthermore demonstrate the "forgiving" characteristic of the P/M materials. While the diameter was increased by 0.010 inch, the final pich diameter increased only 0.002 inch, one-fifth that of the initial blank. It was mentioned before that the final tolerance of a wrought thread is 2 to 3 times the tolerance of the initial blank. These results indicate the broad tolerance range possible with roll threaded P/M blanks. In other words, the starting P/M blank does not require the precision of a wrought metal blank.

The data also show that the density of the P/M thread increases upon thread forming. It should be remembered, however, that the increases shown are due to the elimination of porosity near the tooth surfaces themselves, the central portions of the blanks being unchanged from the original blank densities. The average densities of parts B, C and D is 6.82 g/cc (86.7%), an increase from the initial blank density of 6.56 g/cc (83.3%). The fact that most of this increase is due to the concentration of porosity elimination near the thread root and tooth surface is demonstrated clearly by the increases in shear strength realized.

As will be noted, the cut threads provide much less shear strength in both the non-heat treated and the heat treated condition. Thus, the roll threaded P/M blanks are markedly superior to machined thread P/M blanks. Thread rolling increases the "as rolled threaded" shear strength by over 40% of the shear strength obtained with machined threads and in the heat treated condition by over 75% of the shear strength obtained with heat treated machined threads.

As stated earlier, it is important in roll forming threads on P/M blank that the starting diameter of the blank be larger than the final pitch diameter of the predetermined roll thread product and not substantially exceed the outside diameter (i.e., the major diameter) of the predetermined roll threaded product, the P/M blank diameter selected being substantially inversely related to the density of the porous blank ranging from 75% to 92% of the actual density of the metal making up the blank. For example, the higher the density of the blank, the smaller is the selected diameter so long as it is greater than the final pitch diameter of the roll threaded product and vice versa. It is preferred that the blank diameter prior to thread rolling be between the final pitch diameter and the major diameter of the rolled thread.

An approximate formula that can be employed in determining the starting blank diameter of the P/M blank is given as follows:

TABLE

| | | | BLANK DIAMETER BEFORE FORMING (DENSITY 6.56 g/cc) | | | |
|---|---|---|---|---|---|---|
| | Wrought Formed Thread .331 Blank Diameter | Machined P/M Thread | .331 A | .341 B | .346 C | .356 D |
| Major Diameter | .372 | .372 | .348 | .370 | .376 | .379 |
| Pitch Diameter | .331 | .331 | .318 | .332 | .335 | .337 |
| Minor Diameter | .290 | .290 | .278 | .293 | .293 | .295 |
| Formed Thread Shape | Full Form | Full Form | Incomplete Form | Incomplete Form | Full Form | Full Form |
| Avg. Density After Forming | — | 6.56 g/cc (83.3%) | 6.75 (85.8%) | 6.83 (86.8%) | 6.80 (86.4%) | 6.84 (87.0%) |
| Avg. Shear Strength Before H.T. | —* | 1700# | 2450# | 2450# | 2400# | 2150# |
| Avg. Shear Strength After H.T. | —* | 1760# | 2800# | 3300# | 3300# | 2600# |

*Wrought materials have higher shear strength than P/M materials. The meaningful comparison is between machined P/M threads and rolled P/M threads.

A study of the data in this table reveals that full thread form is achieved with the wrought blank whose blank diameter was 0.331", whereas the P/M blanks at 0.331 inch (A) and 0.341 inch (B) still had incomplete thread forms demonstrating the compressible nature of the P/M material. Full thread form is achieved for the 0.346 and 0.356 inch (C and D) diameter P/M blanks. Forming the oversized thread blanks did not result in die fracture or part fracture as would have occurred with an oversized wrought blank.

blank diam. =

$$\text{pitch diam.} + 2 \times \text{thread height} \times \frac{(100 - \%\ \text{density})}{100}$$

In producing a $\frac{3}{8}$-16 thread from a P/M blank having a density of 83% of actual density, the following blank diameter is employed:

$$\begin{aligned}\text{blank diam.} &= 0.331 + 2 \times .044 \times \frac{(100 - 83)}{100} \\ &= 0.331 + 2 \times .044 \times 0.17 \\ &= 0.331 + 0.015 \\ &= 0.346 \text{ inch}\end{aligned}$$

It will be noted that the blank diameter calculated corresponds to the same blank diameter indicated for P/M blank C hereinabove which provided the desired results.

EXAMPLE 2

An example of a steel alloy for use in producing roll threaded products is a steel known by the designation AISI 4660 containing 1.8% Ni, 0.5% Mo, 0.25Mn, 0.6% C, and the balance essentially iron. The steel except for the carbon is produced as an atomized pre-alloyed powder of particle size less than 100 mesh U.S. Standard. Carbon along with $\frac{3}{4}$% wax is added, the amount of carbon being sufficient to reduce any oxides present and to provide a final carbon content of about 0.6%. The powder mix produced this way will have a greater degree of compressibility.

P/M blanks are formed from the powder mix by cold compression in a die at a compaction force of about 30 tons per square inch (TSI) and the blanks sintered at a temperature of about 2050° F. for 20 minutes at temperature in an atmosphere of dissociated ammonia. During sintering, the carbon diffuses into the alloy quickly and uniformly resulting in a highly homogeneous alloy.

While high carbon materials are normally considered too brittle to deform, it has been observed that porosity is more completely removed in the deformed area when the material is harder.

Following the production of the sintered P/M blank, the material is then thread formed. The forming is set up to inhibit or eliminate as far as it is possible a high stress, low cycle, fatigue failure rather than the limit imposed by tensile ductility. This is achieved by carrying out the forming operations in as few revolutions as possible; fewer than 5 revolutions is preferred, and fewer than 10 revolutions is generally necessary.

Following thread forming, the blank is treated in either of the following ways:

(1) The roll formed blank may be simply hardened by quenching in oil from the austenitizing temperature for the particular steel and then tempered at a temperature from about 250° F. to 400° F. (94° C. to 204° C.) for about 1 hour to 4 hours; or (2) The roll formed blank may be resintered at a temperature of about 2000° F. to 2150° F. (e.g., 2050° F.) for about 20 to 60 minutes at temperature followed by hardening as described above.

In order to assure optimum properties, it is preferred that the latter treatment be used following roll forming of the threads.

In summary, the invention provides as an article of manufacture a sintered thread rolled P/M product characterized by a porous core and highly densified threads, the density of the threads at surface and sub-surface thereof from the root to the crest being at least about 95%, preferably at least about 98%, of the actual density of the metal forming the sintered product, with the density of the porous core ranging from about 75% to 92% and generally from about 80% to 92%. The metals employed may be selected from the group consisting of steel, aluminum alloys, copper alloys, nickel alloys, etc. Steel is preferred. A typical composition range of steel is one containing at least about 65% iron, about 0.3% to 1.5% carbon, and the balance steel alloying ingredients.

Although the present invention has been described in conjunction with preferred embodiments, it is to be understood that modifications and variations thereto may be resorted to without departing from the spirit and scope of the invention as those skilled in the art will readily understand. Such modifications and variations are considered to be within the purview and scope of the invention and the appended claims.

What is claimed is:

1. A method of producing a thread rolled sintered cylindrical metal product which comprises:

forming a sintered cylindrical powder metal (P/M) blank of density ranging from about 75% to 92% of the actual density of said metal having a selected diameter larger than the final pitch diameter of a predetermined roll threaded product produced therefrom and not exceeding the outside diameter of said predetermined roll threaded product, the P/M blank diameter selected being substantially inversely related to the density of said blank, the P/M diameter selected being correlated to produce a substantially full thread, and then thread rolling said sintered P/M blank using a threading die of the same thread gage as the predetermined roll threaded product to be produced, whereby a thread rolled P/M product is produced having a porous core and highly densified threads, the density of the threads at the surface and sub-surface thereof from the root to the crest being at least about 95% of the actual density, with the density of the core ranging from about 75% to 92% of the actual density of the metal forming the product.

2. The method of claim 1, wherein the product after thread rolling is resintered by subjecting it to an elevated sintering temperature.

3. The method of claim 2, wherein the product is made of a metal hardenable by heat treatment, and wherein said product is hardened by heat treatment.

4. A method of producing a thread rolled sintered cylindrical powder metal product which comprises:

forming from a heat treatable steel composition a sintered cylindrical powder metal (P/M) blank of density ranging from about 75% to 92% of the actual density of said steel having a selected diameter larger than the final pitch diameter of a predetermined roll threaded product produced therefrom and not exceeding the outside diameter of said predetermined roll threaded product, the P/M blank diameter selected being substantially inversely related to the density of said blank, the P/M blank diameter selected being correlated to produce a substantially full thread, and then thread rolling said sintered P/M blank using a threading die of the same thread gage of the predetermined roll threaded product to be produced, whereby a thread rolled P/M steel product is produced having a porous core and highly densified threads, the density of the threads at the surface and sub-surface thereof being at least about 95% of the actual density, with the density of the core ranging from about 75% to 92% of the actual density of the steel forming the product.

5. The method of claim 4, wherein the steel product after thread rolling is hardened by heat treatment.

6. The method of claim 4, wherein the steel product after thread rolling is resintered at an elevated sintering temperature and thereafter hardened by heat treatment.

7. The method of claim 4, wherein the heat treatable steel contains at least about 65% iron, about 0.3 to 1.5% carbon and the balance steel alloying ingredients.

8. A method of producing a thread rolled sintered cylindrical powder metal product which comprises:

forming from a heat treatable steel composition a sintered cylindrical powder metal (P/M) blank of density ranging from about 75% to 92% of the actual density of said steel having a selected diameter larger than the final pitch diameter of a predetermined roll threaded product produced therefrom and not exceeding the outside diameter of said predetermined roll threaded product, the P/M blank diameter selected being substantially inversely related to the density of said blank, the P/M diameter selected being correlated to produce a substantially full thread, said selected blank diameter being determined by the following approximate formula:

$$\text{blank diam.} = \text{pitch diam.} + 2 \times \text{thread height} \times \frac{(100 - \%\ \text{density})}{100}$$

and then thread rolling said sintered P/M blank using a threading die of the same thread gage of the predetermined roll threaded product to be produced, whereby a thread rolled P/M product is produced having a porous core and highly densified threads, the density of the threads at the surface and sub-surface thereof from the root to the crest being at least about 95% of the actual density of the steel, with the density of the core ranging from about 75% to 92% of the actual density of the steel forming the product.

9. The method of claim 8, wherein the steel product after thread rolling is hardened by heat treatment.

10. The method of claim 8, wherein the steel product after thread rolling is resintered at an elevated sintering temperature and thereafter hardened by heat treatment.

11. The method of claim 8, wherein the heat treatable steel contains at least about 65% iron, about 0.3 to 1.5% carbon and the balance steel alloying ingredients.

12. As an article of manufacture, a sintered thread rolled P/M product, said thread rolled product being characterized by a porous core and highly densified threads, the density of the threads at the surface and sub-surface thereof from the root to the crest being at least about 95% of the actual density, with the density of the porous core ranging from about 75% to 92% of the actual density of the metal forming the product.

13. The article of manufacture of claim 12, wherein the density of said threads is at least about 98%, and wherein the density of the core ranges from about 80% to 92%.

14. As an article of manufacture, a sintered thread rolled P/M product formed of a heat treatable steel composition containing at least about 65% iron, about 0.3 to 1.5% carbon and the balance steel alloying ingredients, said thread rolled product being characterized by a porous core and highly densified threads, the density of the threads at the surface and sub-surface thereof from the root to the crest being at least about 95% of the actual density, with the density of the porous core ranging from about 75% to 92% of the actual density of the steel composition forming the product.

15. The article of manufacture of claim 14, wherein the density of said threads is at least about 98%, and wherein the density of the porous core ranges from about 80% to 92%.

16. The article of manufacture of claim 14, wherein said sintered thread rolled product is in the heat treated hardened state.

* * * * *